United States Patent [19]

Hattori et al.

[11] Patent Number: 5,032,496

[45] Date of Patent: Jul. 16, 1991

[54] LIGHT-SENSITIVE COLOR PHOTOGRAPHIC MATERIAL HAVING SUPERIOR COLOR REPRODUCIBILITY

[75] Inventors: Tsuyoshi Hattori; Shin-ichi Daiba, both of Hino, Japan

[73] Assignee: Konica Corporation, Tokyo, Japan

[21] Appl. No.: 515,785

[22] Filed: Apr. 24, 1990

Related U.S. Application Data

[63] Continuation of Ser. No. 212,976, Jun. 29, 1988, abandoned.

[30] Foreign Application Priority Data

Jul. 2, 1987 [JP] Japan ..... 62-166156

[51] Int. Cl.[5] ..... G03C 7/18

[52] U.S. Cl. ..... 430/504; 430/359; 430/506; 430/362

[58] Field of Search ..... 430/504, 506, 359, 362

[56] References Cited

U.S. PATENT DOCUMENTS

| | | | |
|---|---|---|---|
| 2,428,054 | 9/1947 | Vittum et al. | 430/354 |
| 2,704,711 | 3/1955 | Hanson | 430/504 |
| 4,023,970 | 5/1977 | Hellmig et al. | 430/509 |
| 4,082,553 | 4/1978 | Groet | 430/506 |
| 4,156,608 | 5/1979 | Vetter et al. | 430/504 |
| 4,273,861 | 6/1981 | Shiba et al. | 430/504 |
| 4,555,477 | 11/1985 | Washburn | 430/359 |
| 4,557,998 | 12/1985 | Washburn et al. | 430/359 |

*Primary Examiner*—Richard L. Schilling
*Attorney, Agent, or Firm*—Jordan B. Bierman

[57] ABSTRACT

A light-sensitive color photographic material with improved color reproducibility which comprises on a support a plurality of light-sensitive silver halide emulsion layers including a red-sensitive silver halide emulsion layer, a green-sensitive silver halide emulsion layer, a blue-sensitive silver halide emulsion layer and at least one silver halide emulsion layer having reverse photoresponse to that of the red-, green-, and blue-sensitive silver halide emulsion layers, being capable of forming a reverse dye image having substantially the same hue as that is to be formed in the green-sensitive silver halide emulsion layer, and having maximun sensitivity wavelength (λ−G) of the spectral sensitivity distribution in the region of from 400nm to 500nm.

1 Claim, 2 Drawing Sheets

○ : COLOR CHECKER (MACBETH CO.)

△ : PRINT NO. 1

□ : PRINT NO. 2

○ : COLOR CHECKER (MACBETH CO.)

△ : PRINT NO. 1

□ : PRINT NO. 2

○ : COLOR CHECKER (MACBETH CO.)

△ : PRINT NO. 1

□ : PRINT NO. 3

LIGHT-SENSITIVE COLOR PHOTOGRAPHIC MATERIAL HAVING SUPERIOR COLOR REPRODUCIBILITY

This application is a continuation of application Ser. No. 07/212,976, filed Jun. 29, 1988, now abandoned.

FIELD OF THE INVENTION

The present invention relates to a light-sensitive color photographic material having superior color reproducibility. It provides a light-sensitive color photographic material having superior color reproducibility particularly with fidelity to yellow, yellowish green, green and magenta.

BACKGROUND OF THE INVENTION

In the field of light-sensitive color photographic materials, various attempts have been hitherto made to improve color reproducibility. They are, for example, (a) in the case of light-sensitive color negative materials, to impart a development restraining effect to layer interfaces, and (b) to impart an automask function attributable to colored couplers.

However, the techniques of the above (a) and (b) can not be said to have been accomplished in the sense of the color reproduction with fidelity. For example, yellow inclines to orange, green loses its chroma, and both of them turn dark. Also, yellowish green inclines to yellow, and magenta turns into a color slightly inclining to red. In particular, when it is attempted to reproduce yellowish green, lawns, for example, that must be yellow-green look withered to make visually bad impression, and this has offered an important problem. Such a problem is considered to greatly depend on the spectral sensitivity of light-sensitive materials.

Light-sensitive color photographic materials, for example, light-sensitive color negative materials, are spectrally sensitized for a red-sensitive layer, a green-sensitive layer and a blue-sensitive layer so as to respond to red light, green light and blue light, respectively. These three kinds of light-sensitive layers have an overlap each other in the spectral sensitivities.

Ideally speaking, the spectral sensitivities of the three kinds of light-sensitive layers may be bounded by specific wavelengths without gaps and also without overlaps to entirely fill up the visible region, but this kind of things is actually impossible.

The overlaps of spectral sensitivities bring about turbidity of colors to cause obstruction of the color reproducibility with fidelity in printing.

Also, if the spectral sensitivities are made sharp so as not to be overlapped, holes of sensitivities, so to speak, in other words, unsensitized portions, are produced in the boundary wavelength region to cause there absence of color information, also resulting in obstruction of color reproducibility with fidelity in printing.

For the reasons like this, the spectral sensitivities in actual light-sensitive color photographic materials are set in realizable limitations with appropriate sharpness and appropriate overlaps.

SUMMARY OF THE INVENTION

Based on such circumstances, the present inventors have made intensive researches to solve the above problems, and an object of the present invention is to provide a light-sensitive color photographic material having superior color reproducibility particularly with fidelity to yellow, yellowish green, green and magenta.

The present invention relates to a light-sensitive color photographic material comprising a support having thereon a red-sensitive silver halide emulsion layer, a green-sensitive silver halide emulsion layer and a blue-sensitive silver halide emulsion layer, wherein said color photographic material comprises at least one light-sensitive silver halide emulsion layer having a reverse light-response to said emulsion layers, capable of forming a dye image having substantially the same hue with that to be formed in the green-sensitive silver halide emulsion layer, and having a maximum sensitivity wavelength ($\lambda_{-G}$) of spectral sensitivity distribution in the range of 400 nm$\leqq\lambda_{-G}\leqq$500 nm.

As set out above, in the present invention, providing an emulsion layer having a reverse light-response to usual emulsion layers in respect of the light of a particular wavelength region, and capable of forming a dye image having substantially the same hue with one to be formed in a green-sensitive silver halide emulsion layer enables formation of an image (magenta image in usual cases) having a negative sensitivity, so to speak, to the light of a particular wavelength region and at the same time corresponding to a hue formed by the green-sensitive silver halide emulsion layer, thus making it possible to improve the color reproducibility particularly of yellow, greenish yellow, green and magenta.

Figure 1:
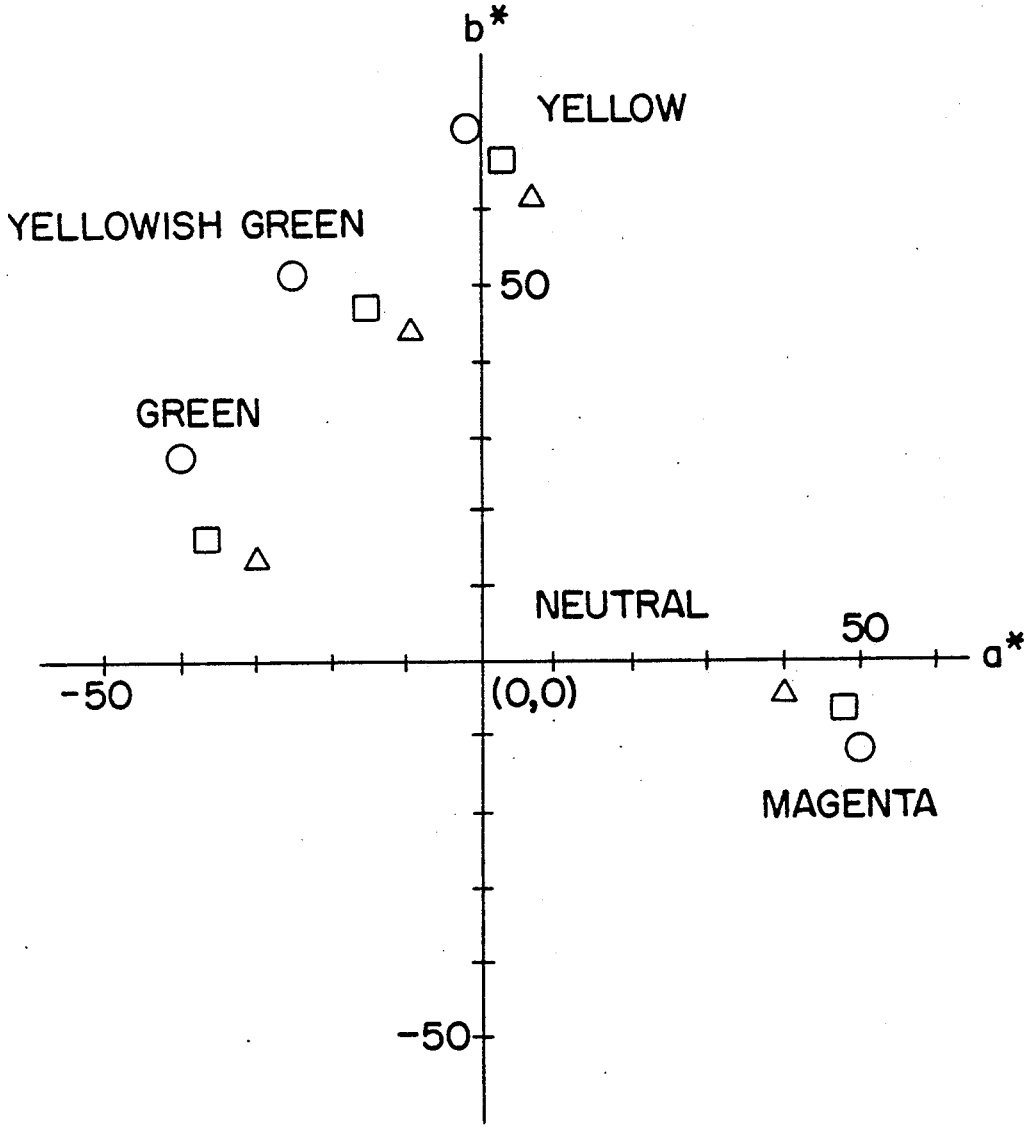
FIG. 1 and FIG. 2 are views in which yellow, yellowish green, green and magenta are each indicated on an (a*, b*) plane of an (L*, a*, b*) chromaticity diagram.

In the drawing, ○ represents a color coordinate of a color chart [Color Checker (manufactured by Macbeth Company)]; Δ, a color coordinate of Print No. 1 using Sample No. 1; and □, a color coordinate of Print No. 2 using Sample No. 2.

DETAILED DESCRIPTION OF THE INVENTION

In a preferred embodiment of the present invention, the light-sensitive material of the present invention is so constituted that a silver halide emulsion layer spectrally sensitized to 400 nm$\leqq\lambda_{-G}\leqq$500 nm in the above maximum sensitivity wavelength ($\lambda_{-G}$) of spectral sensitivity distribution contains a DIR compound or DIR coupler capable of releasing a development restrainer, or a compound capable of releasing a development restrainer, through coupling with an oxidized product of a developing agent, and containing in the above layer or an adjacent layer thereto a silver halide emulsion beforehand fogged and a coupler that forms an image having substantially the same hue with that to be formed in the green-sensitive silver halide emulsion layer.

Taking this embodiment, the layer containing a silver halide emulsion beforehand fogged and a coupler that forms an image having substantially the same hue with a green-sensitive silver halide emulsion layer forms a color (magenta color-formation in usual cases) that is entirely solid, if it is developed as it is. However, incorporation of the material capable of restraining the development as mentioned above results in suppression of the color-formation at an exposed area, thus exhibiting the action of the present invention.

In another preferred embodiment of the present invention, the present invention is so constituted that the above reverse light-responsive silver halide emulsion layer contains a negative emulsion spectrally sensitized to the range of 400 nm$\leqq\lambda_{-G}\leqq$500 nm, and at the same time contains a DDR (diffusible dye releasing) coupler or DRR (dye-releasing redox) compound having substantially the same hue with a formed image in a green-sensitive silver halide emulsion layer. This brings about the action same as in the above.

In still another preferred embodiment of the present invention, the present invention is so constituted that the above reverse light-responsive silver halide emulsion layer contains a positive emulsion spectrally sensitized to the range of 400 nm$\leqq\lambda_{-G}\leqq$500 nm, and at the same time contains a coupler that forms an image having substantially the same hue with a formed image in a green-sensitive silver halide emulsion layer. In this instance, the positive emulsion has an action reverse to the above negative emulsion, so that the above negative may result in the sameness with the combination of the emulsion with DDR coupler or DRR coupler, so exhibiting the action of the present invention.

Thus, in the present invention, it is important that an image having substantially the same hue with a formed imaged in a green-sensitive silver halide emulsion layer turns to a color image of the so-called positive type, which has a light-response reverse to color images of usual negatives, corresponding to the light of the blue sensitive region.

The principle of the present invention resides in that a compound having the action of extinguishing the color-formation of, for example, a magenta coupler showing sensitivity to blue light and responding to the green-sensitivity when, for example, it received blue light, thereby extinguishing the magenta color-formation at the overlapping area at the foot on each wavelength distribution of blue and green to make a sharp color.

In the present invention, "substantially the same hue" means that the maximum absorption wavelengths of spectral absorption spectrums are not deviated 40 nm or more.

The combination of the emulsions and coloring materials (color-forming agents) covers a wide range, but typical examples are shown below in (1) to (3).

(1) Combination of a positive emulsion with a coloring material for magenta color-formation.

The positive emulsion is typified by an emulsion of internal latent image type, and may be optionally used in combination with a nucleating agent (such as dopant). The coloring material for magenta color-formation includes magenta couplers.

(2) Combination of a negative emulsion with a magenta-colored coloring material capable of releasing a magenta dye through reaction with an oxidized product of a color developing agent.

The magenta-colored coloring material includes DRR compounds (including DDR couplers). Here, the DDR couplers may be either non-color-forming type or yellow color-forming type.

(3) Combination of a negative emulsion, a DIR compound (including a DIR coupler), a development restrainer being split off through coupling of this DIR coupler with an oxidized product of a developing agent (or a compound capable of releasing a developing restrainer), a beforehand fogged emulsion susceptible to suppression by this development restrainer or the like, and a coloring material for magenta color-formation.

Two or more of the above typical examples (1) to (3) may be combined. Needless to say, the present invention is by no means limited to these typical examples.

Specific constitution of the present invention will be described below in detail. In instances in which the positive emulsion is used in the present invention, the emulsion can be prepared by the following various methods.

(a) A method in which the so-called internal latent image silver halide emulsion having sensitivity specs inside emulsion grains is treated in the presence of a fogging agent or a nucleus-imparting agent.

This method is described in U.S. Pat. Nos. 2,592,250, 3,206,313, 3,447,927, 3,761,276, 3,935,014, etc. The fogging agent or nucleus-imparting agent typically includes hydrazines described in U.S. Pat. Nos. 2,588,982 and 2,563,785; hydrazides and hydrazones described in U.S. Pat. No. 3,227,552; quaternary chloride compounds described in British Patent No. 1,283,835, Japanese Patent Publication No. 38164/1974, U.S. Pat. Nos. 3,734,738, 3,719,494 and 3,615,615; sensitizing dyes having in a dye molecule a substituent having fogging action, as described in U.S. Pat. No. 3,718,470; and acylhydrazinophenylthiourea compounds described in U.S. Pat. Nos. 4,030,925 and 4,031,127.

(b) A method in which the surfaces of emulsion grains internally having sensitivity specs are beforehand fogged chemically or by irradiating radiations.

The emulsion prepared in this manner directly gives a positive image by itself. This method is described in Japanese Patent Publication Nos. 4125/1968 and 29405/1968, U.S. Pat. Nos. 2,401,051, 2,976,149 and 3,023,102, British Patent Nos. 707,704 and 1,097,999, French Patent Nos. 1,520,824 and 1,520,817, Belgium Patent Nos. 713,272, 721,567 and 681,768.

(c) A method in which the surfaces of emulsion grains internally having no sensitivity specs are beforehand fogged chemically or by irradiating radiations. This emulsion gives no direct positive image by itself, but gives a direct positive image by using an organic desensitizer.

This method is described in British Patent Nos. 1,186,717, 1,186,714 and 1,186,716, U.S. Pat. Nos. 3,501,306, 3,501,307, 3,501,310, 3,531,288, 1,520,817, etc. The positive emulsions obtained by these methods may be spectrally sensitized so that the maximum sensitivity wavelength ($\lambda_{-G}$) may come to be 400 nm$\leqq\lambda_{-G}\leqq$500 nm, and used together with a magenta coupler which is the coloring material for magenta color-formation.

In instances where negative emulsions spectrally sensitized so that the $\lambda_{-G}$ may come to be 400 nm$\leqq\lambda_{-G}\leqq$500 nm, positive images of remaining coloring materials can be obtained by using, for example, a colored coupler as a coloring material.

To make adaptation to the object of the present invention, a magenta colored non-color-forming coupler or a magenta colored yellow coupler may be used as the coloring material. Examples of the compounds are shown below, but as a matter of course the present invention is by no means limited to these.

Exemplary Compounds (A-1)
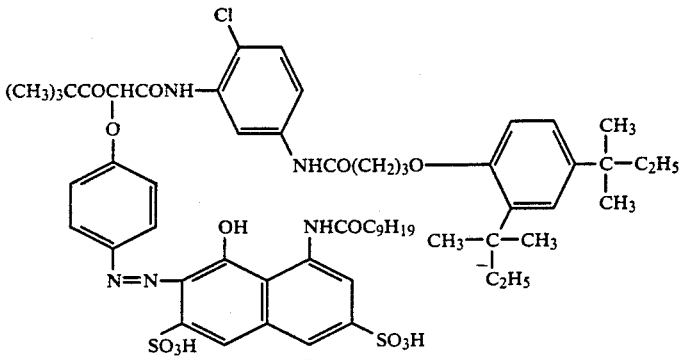
(A-2)
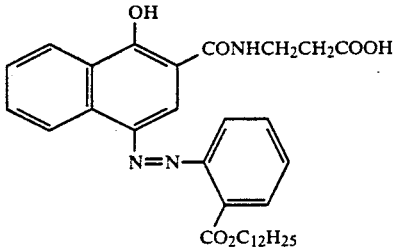
(A-3)
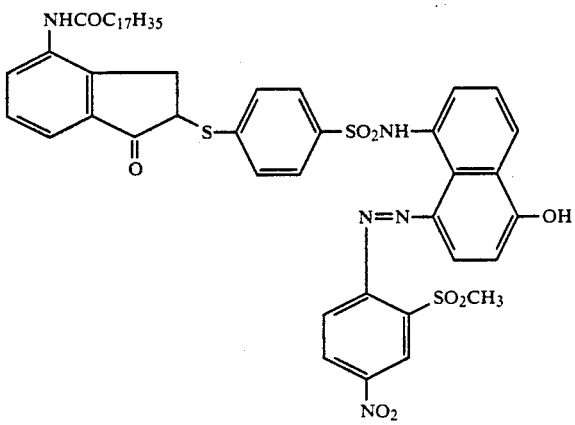
(A-4)
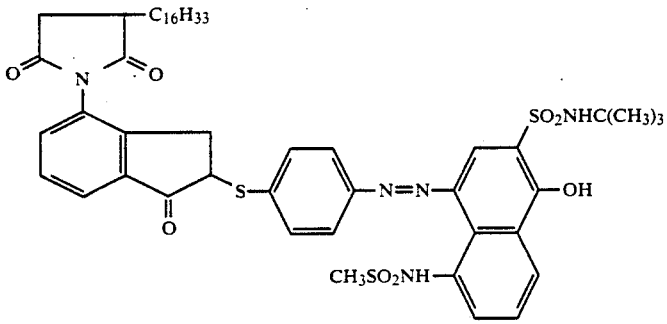
(A-5)
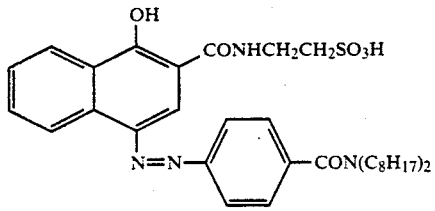
DRR compounds may also be used as the coloring material. Examples of the DRR compounds are shown below, but as a matter of course the present invention is by no means limited to these.
Exemplary Compounds

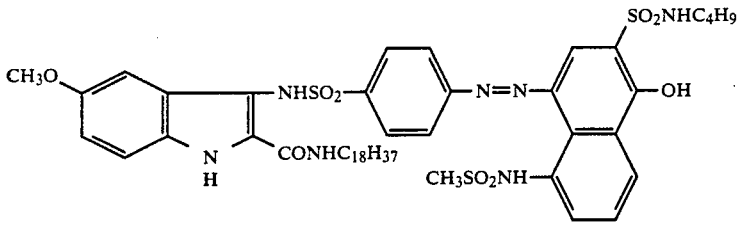

(B-1)

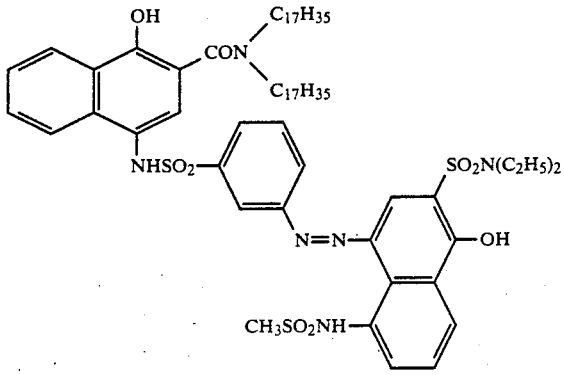

(B-2)

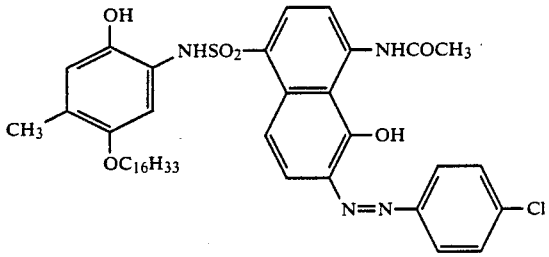

(B-3)

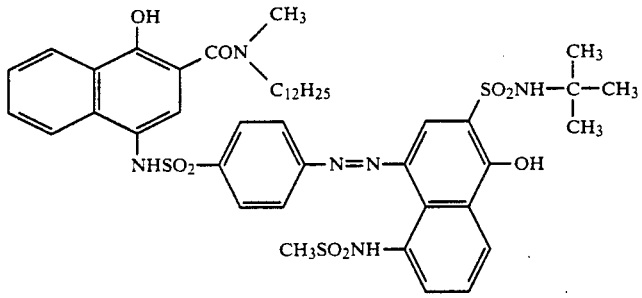

(B-4)

A light-sensitive material having a positive type light-response can be also obtained as a silver halide emulsion layer unit by incorporating into the same layer with that of the above negative emulsion a DIR compound (including DIR couplers) capable of releasing a development restrainer (or a compound capable of releasing a developing restrainer) through coupling with an oxidized product of a developing agent, and incorporating in an adjacent layer a beforehand fogged silver halide emulsion and a coupler that forms an image substantially the same color hue as in a green-sensitive silver halide emulsion layer.

Preferably usable DIR compounds include the compounds described, for example, in U.S. Pat. Nos. 3,632,345, 3,928,041, 3,938,996, 3,958,993, 3,961,959, 4,046,574, 4,052,213, 4,171,223 and 4,186,012, Japanese Unexamined Patent Publications Nos. 65433/1977, 130327/1977 and 128335/1977.

The DIR couplers may include, for example, those capable of releasing a heterocyclic mercapto type development restrainer as described in U.S. Pat. No. 3,227,554, etc.; those capable of releasing a benzotriazole derivative as a development restrainer as described in Japanese Patent Publication No. 9942/1983, etc.; the so-called non-color-forming DIR couplers described in Japanese Patent Publication No. 16141/1976, etc.; those capable of releasing a nitrogen-containing heterocyclic development restrainer, accompanied with decomposition of methylol after elimination, as described in Japanese Unexamined Patent Publication No. 90932/1977; those capable of releasing a development restrainer, accompanied with intramolecular nucleophilic reaction after elimination, as described in U.S. Pat. No. 4,248,962; those capable of releasing a development restrainer by the action of electron migration through a conjugated system after elimination, as described in Japanese Unexamined Patent Publication Nos. 114946/1981, 56837/1982, 154234/1982, 188035/1982, 98728/1983, 209736/1983, 209737/1983, 209738/1983, 209740/1983, etc.; those capable of releasing a non-diffusible development restrainer whose development restraining ability is inactivated in a developing solution as described in Japanese Unexamined Patent Publication Nos. 151944/1982, 217932/1983, etc.; and those capable of releasing a reactive compound to form a development restrainer or deactivate a development restrainer by reaction in layer in developing as described in Japanese Patent Unexamined Publication No. 201245/1986. Of the DIR couplers set out above, more preferred ones in combination with the present invention include the developing solution deactivating types typified by Japanese Unexamined Patent Publication No. 151944/1982; the timing types typified by U.S. Pat. No. 4,248,962 and Japanese Unexamined Patent Publication No. 154234/1982; and the reaction types typified by Japanese Patent Unexamined Publication No. 201245/1986, and particularly preferred among them are the developing solution deactivation type DIR couplers described in Japanese Unexamined Patent Publication Nos. 151944/1982, 217932/1983, 75474/1984, 82214/1984 and 90438/1984, etc. and the reaction type DIR couplers as described in Japanese Patent Application No. 39653/1984, etc.

Preferred examples of the DIR couplers used in the present invention are shown below. As a matter of course, it is needless to say that the present invention is by no means limited by these compounds.

Exemplary Compounds (D-1)

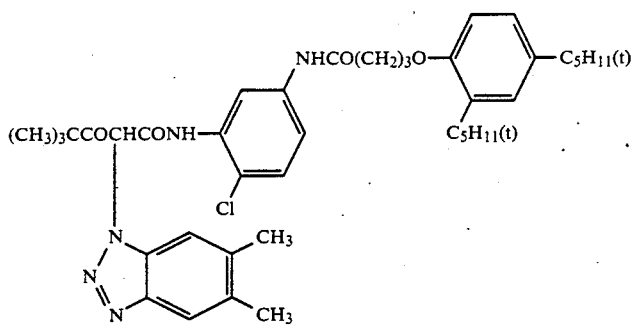

(D-2)

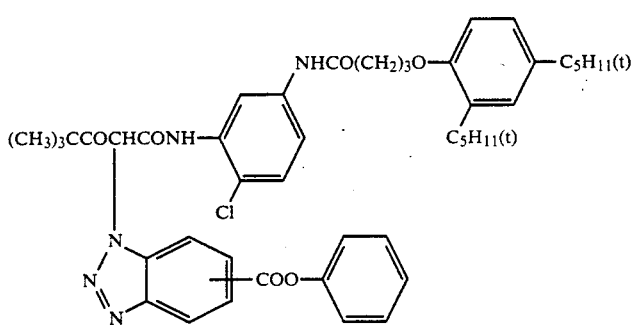

(D-3)

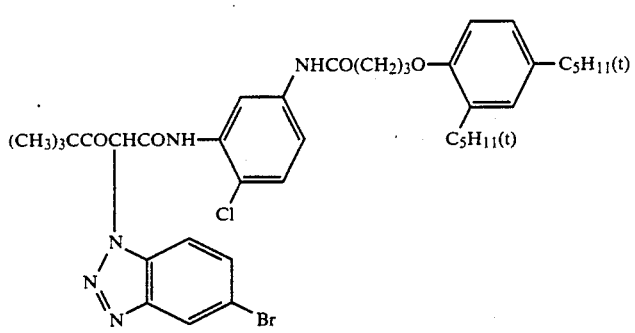

(D-4)

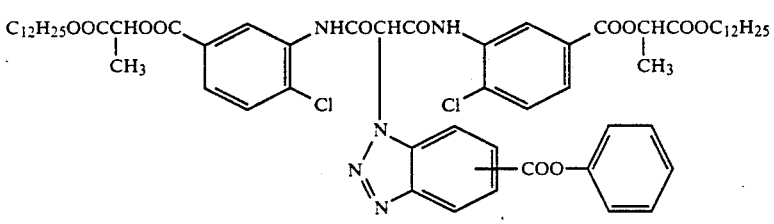

-continued
(D-5)
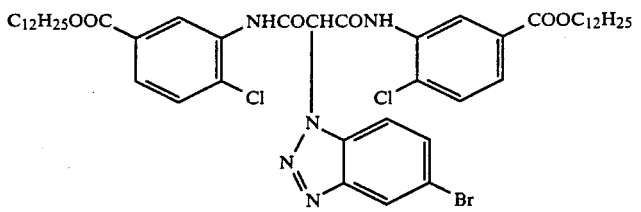
(D-6)
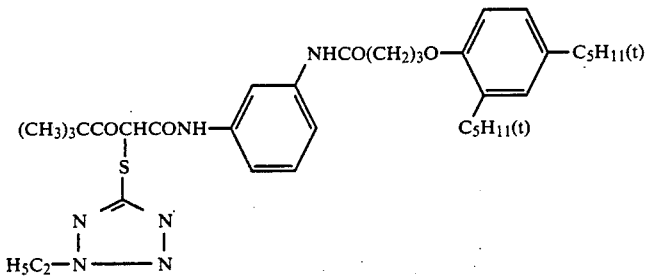
(D-7)
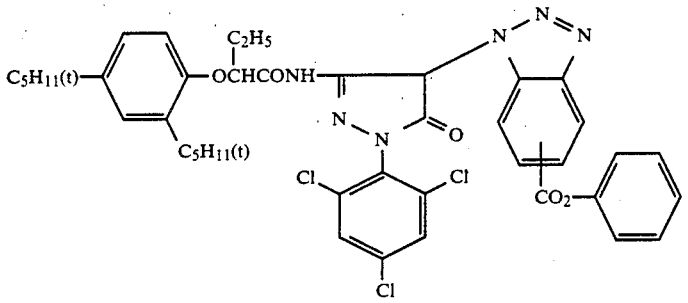
(D-8)
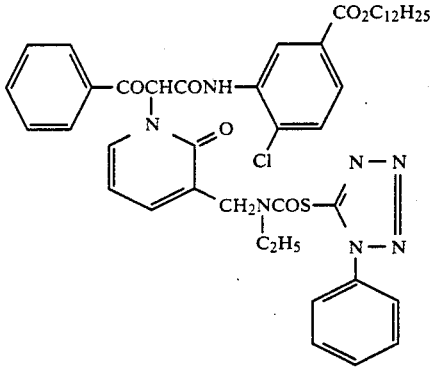
(D-9)
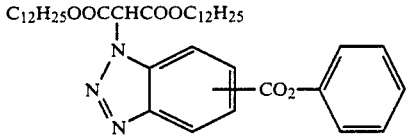
(D-10)
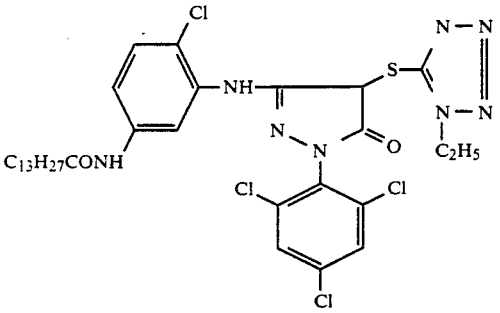

-continued
(D-11)
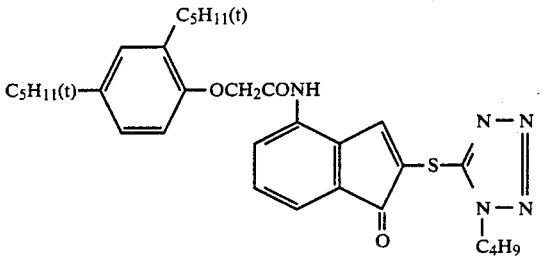
(D-12)
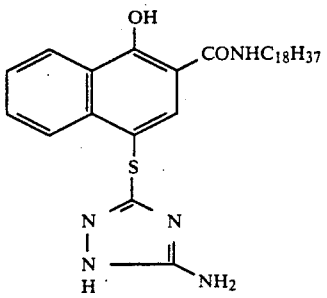
(D-13)
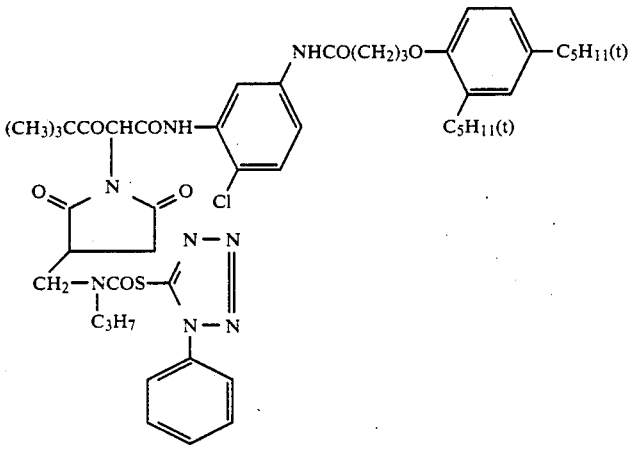
(D-14)
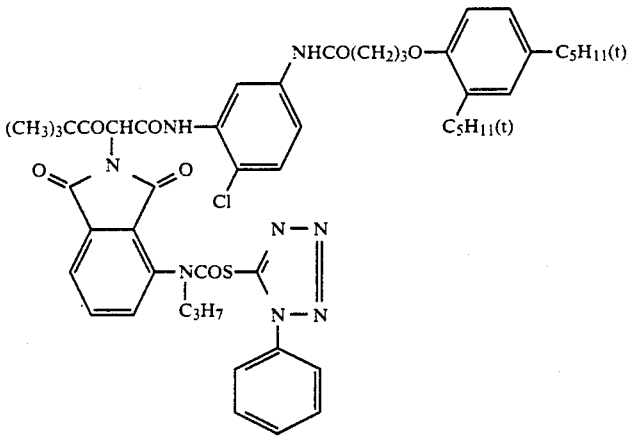

-continued
(D-15)
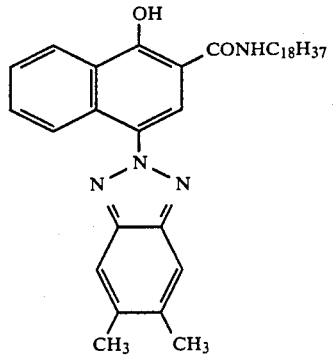
(D-16)
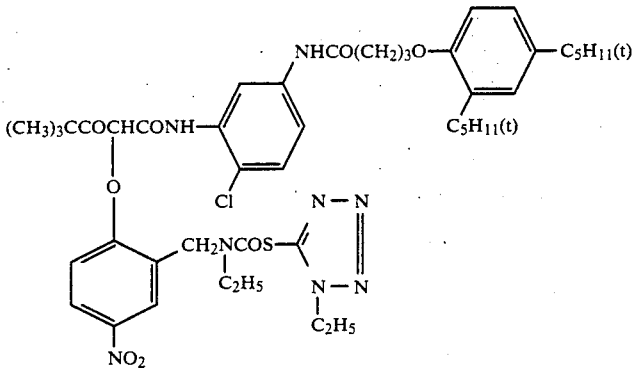
(D-17)
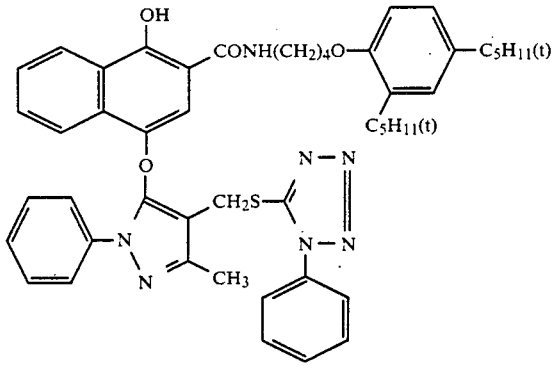
(D-18)
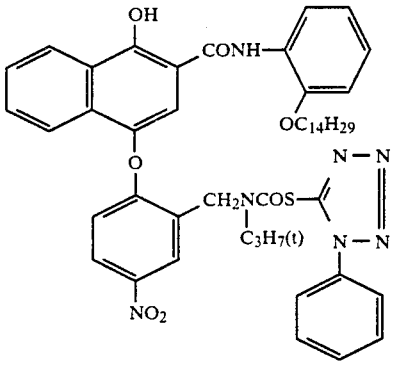

-continued
(D-19)
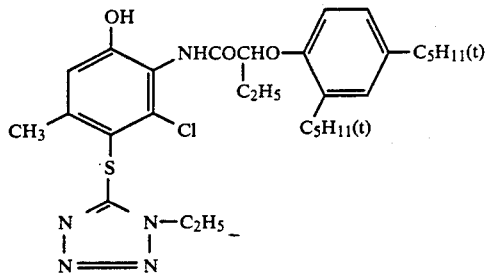
(D-20)
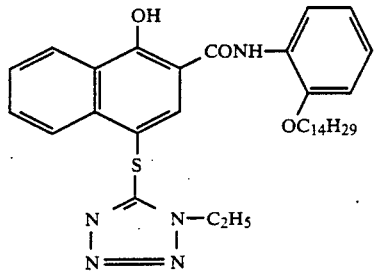
(D-21)
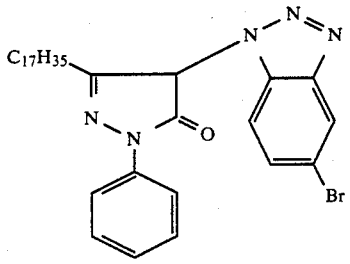
(D-22)
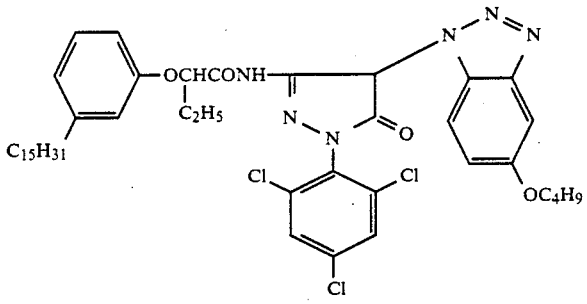
(D-23)
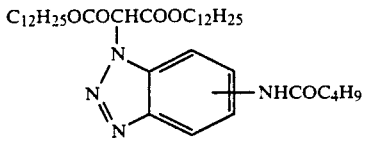
(D-24)
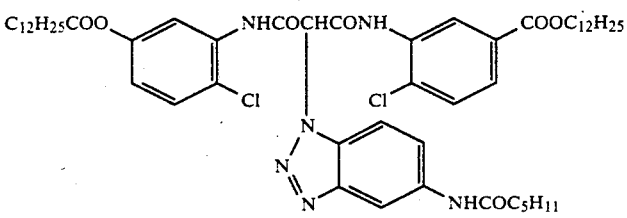

-continued
(D-25)
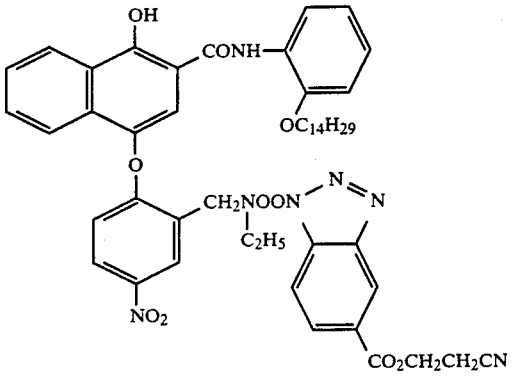
(D-26)
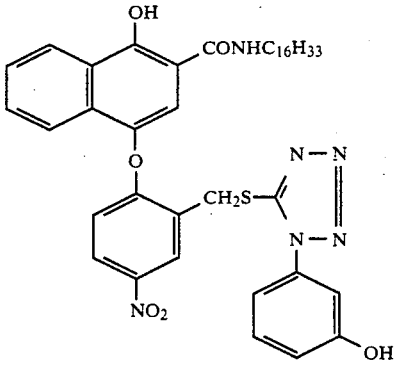
(D-27)
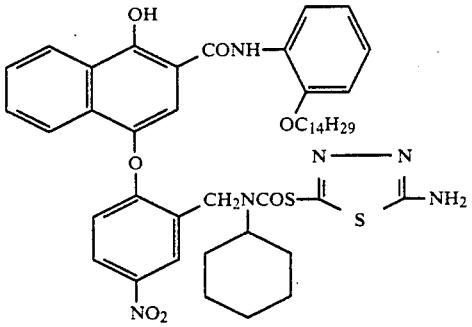
(D-28)
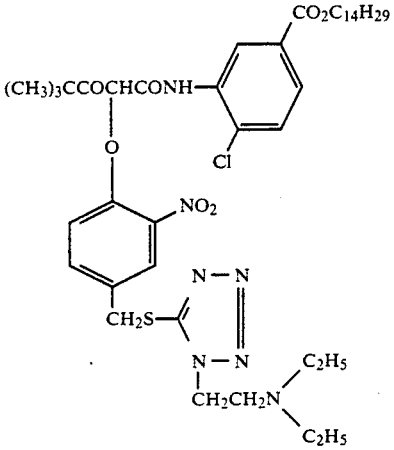

-continued
(D-29)
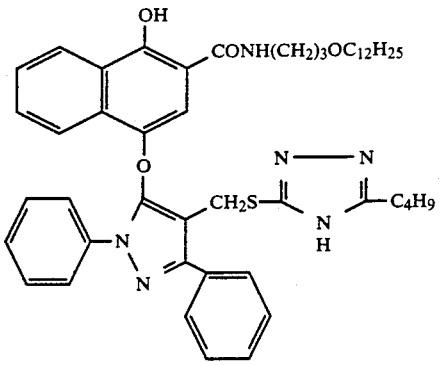
(D-30)
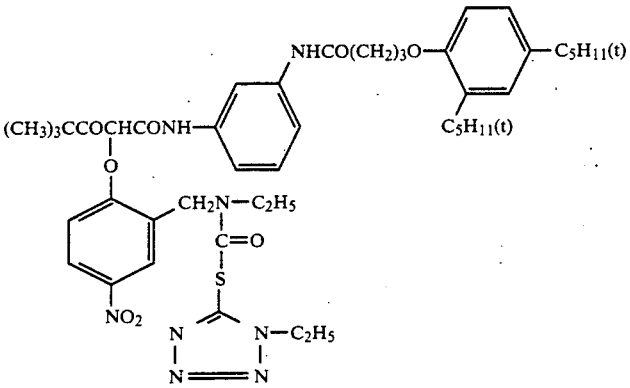
(D-31)
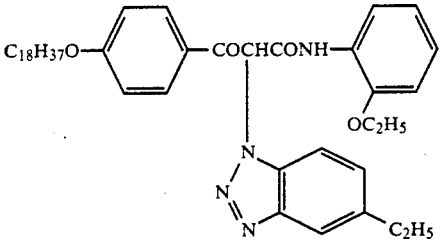
(D-32)
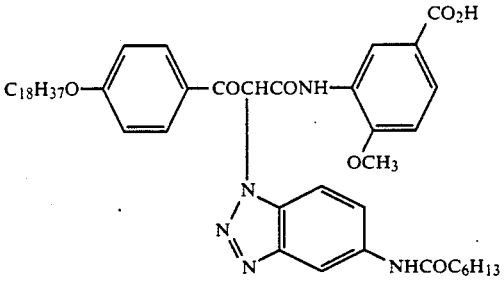
(D-33)
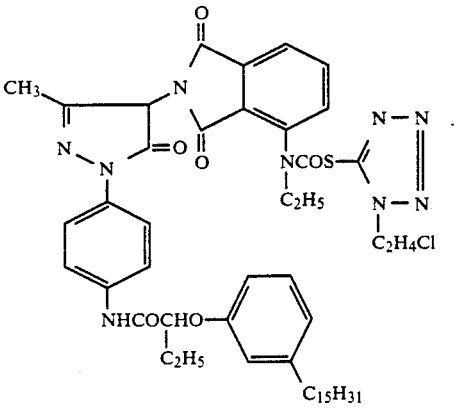

-continued
(D-34)
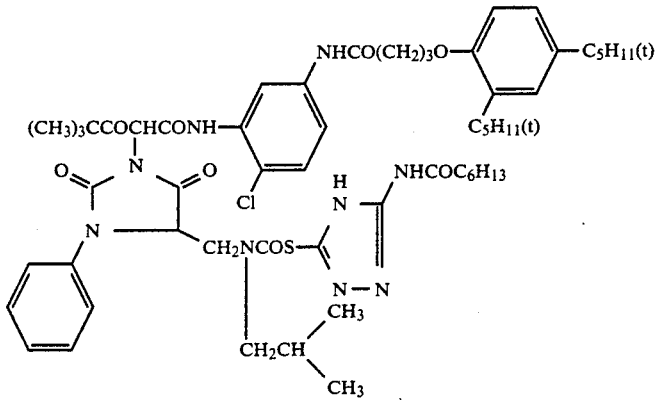
(D-35)
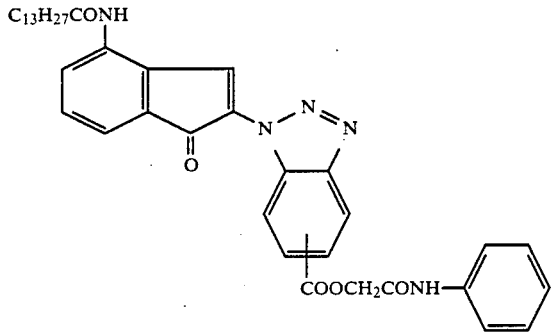
(D-36)
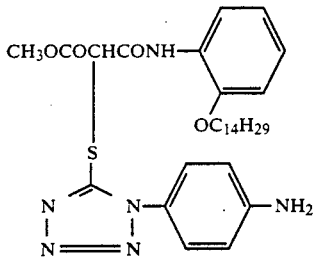
(D-37)
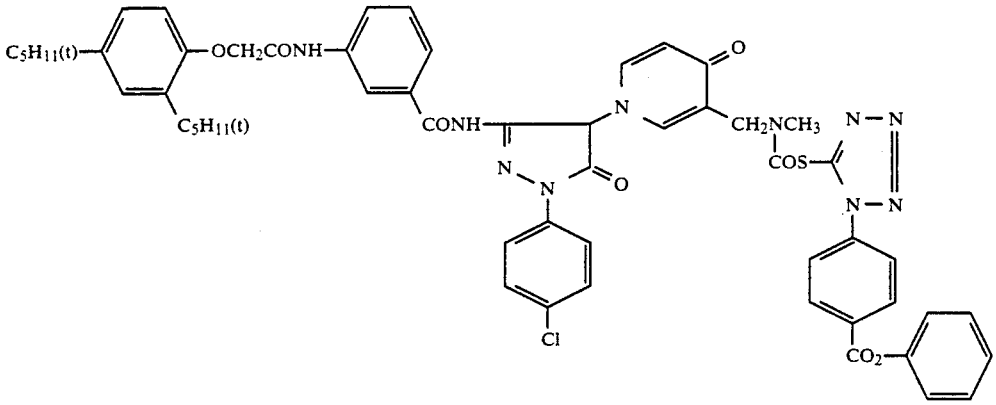

-continued
(D-38)
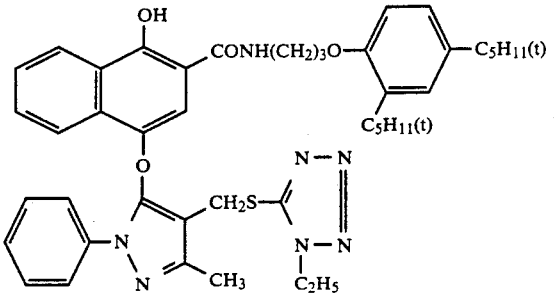
(D-39)
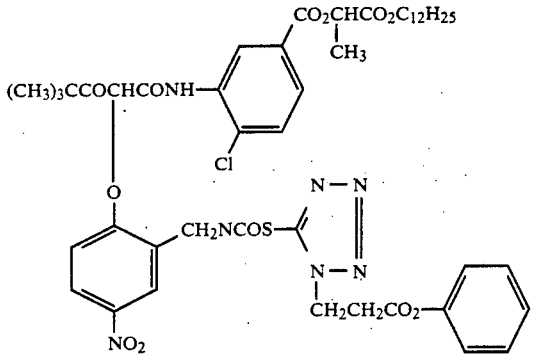
(D-40)
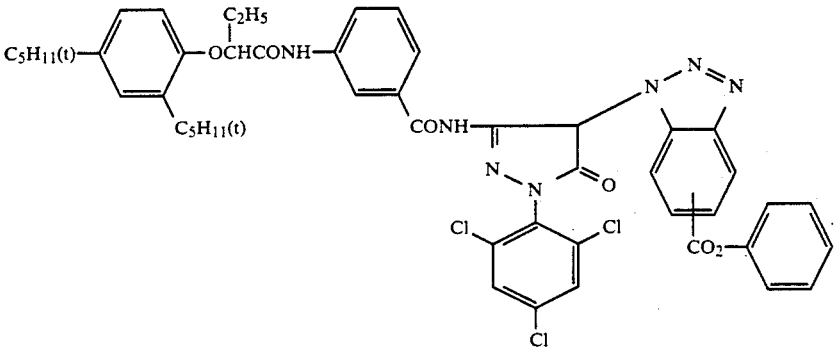
(D-41)
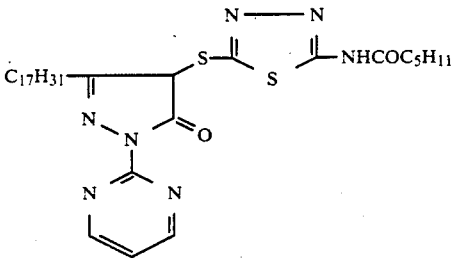
(D-42)
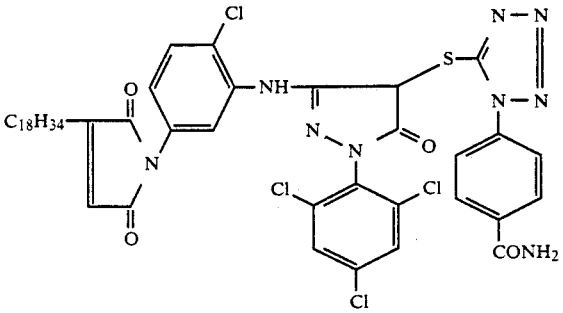

-continued
(D-43)
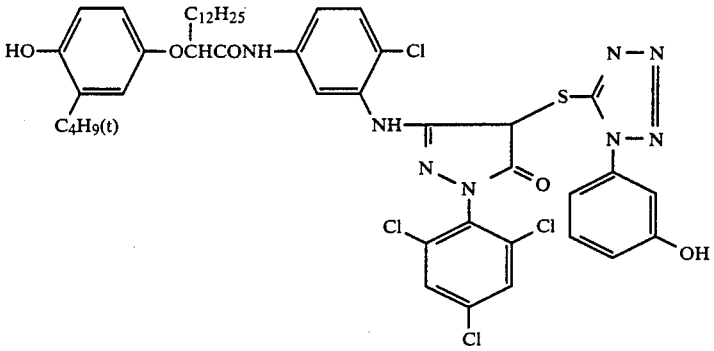
(D-44)
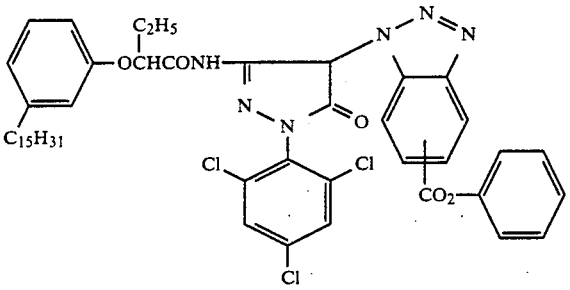
(D-45)
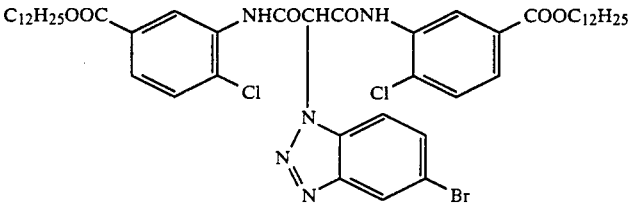
(D-46)
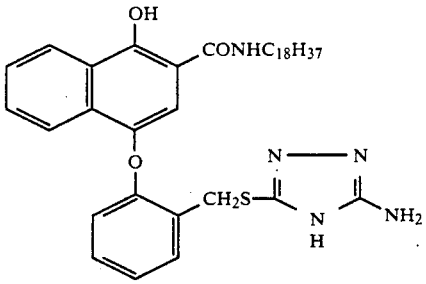
(D-47)
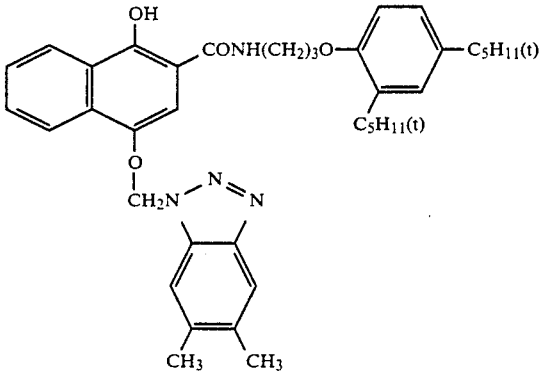

-continued
(D-48)
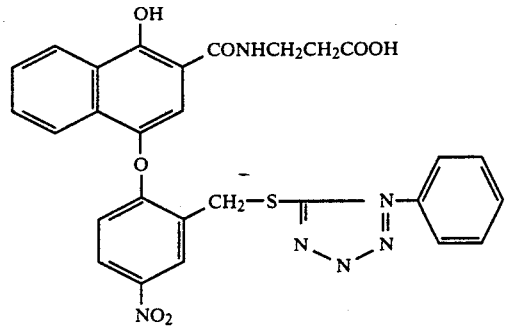
(D-49)
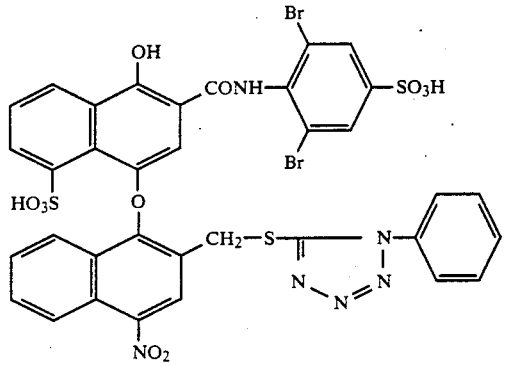
(D-50)
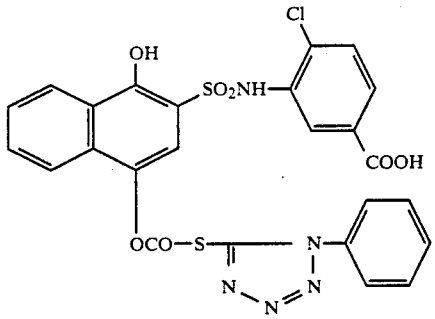
(D-51)
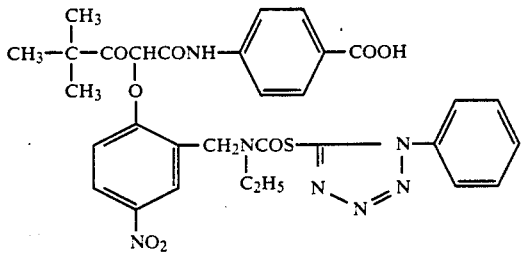

-continued
(D-52)
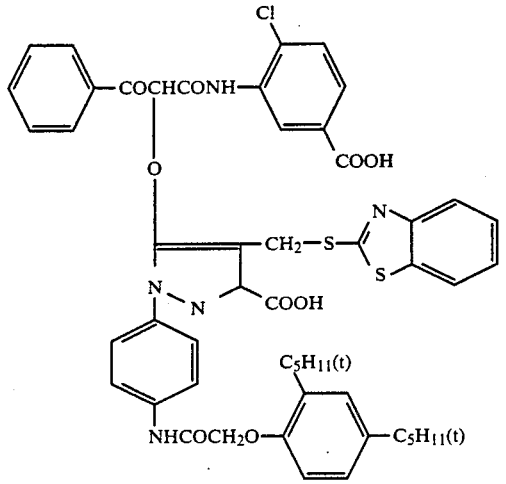
(D-53)
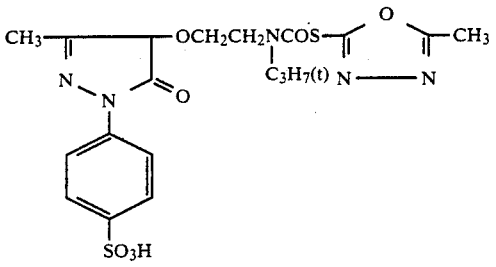
(D-54)
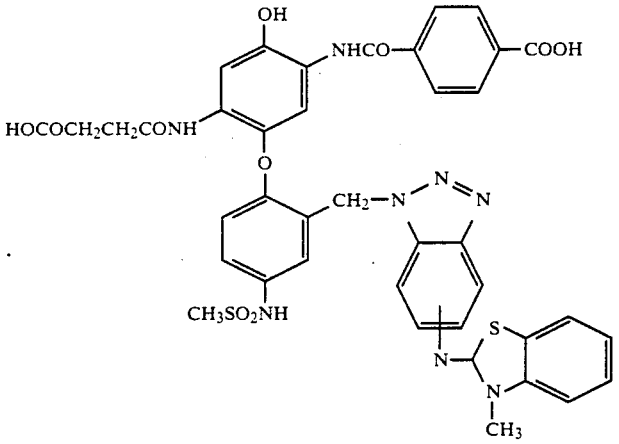
(D-55)
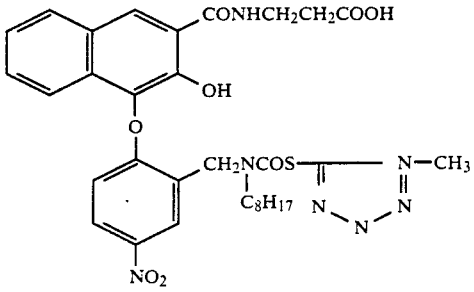

-continued (D-56)

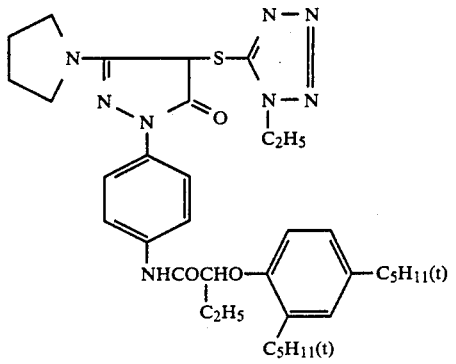

(D-57)

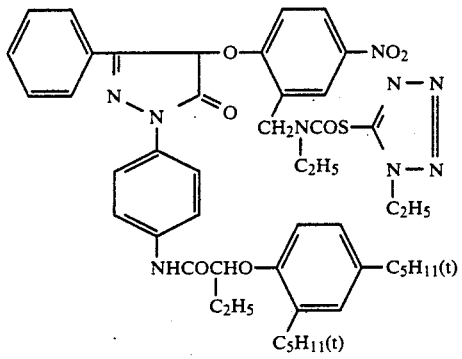

(D-58)

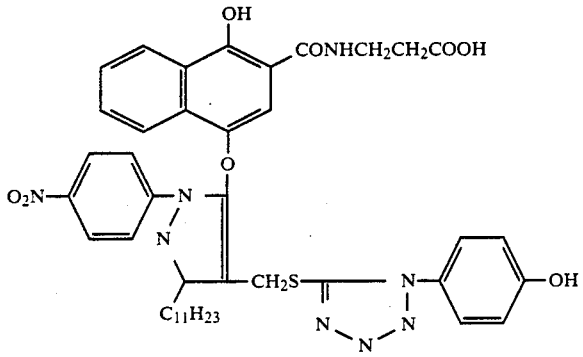

(D-59)

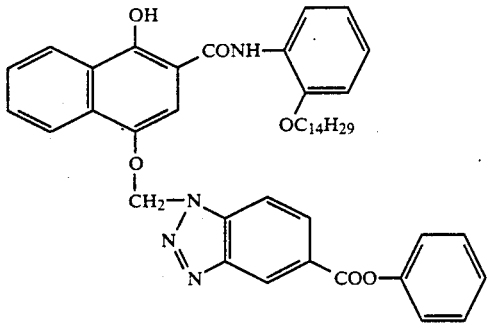

The beforehand fogged emulsion can be also prepared, for example, by a method in which fogging is effected by irradiating light on an emulsion in the course of from formation of silver halide grains up to coating, or a method in which fogging is effected by chemically treating the surfaces of emulsion grains.

To spectrally sensitize the silver halide emulsion layer or unit having a positive type light-response so that the $\lambda_{-G}$ comes to be 400 nm $\leqq \lambda_{-G} \leqq$ 500 nm, various methine dyes can be used as spectrally sensitizing dyes. Particularly preferred are dyes belonging to merocyanine dyes and composite merocyanine dyes.

Examples of the dyes used in the present invention are shown below in Series (I), Series (II) and Series (III). As a matter of course, it is needless to say that the present invention is by no means limited to these compounds.

Series (I)

(I-1)
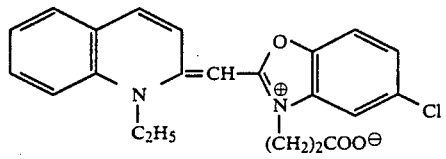
(I-2)
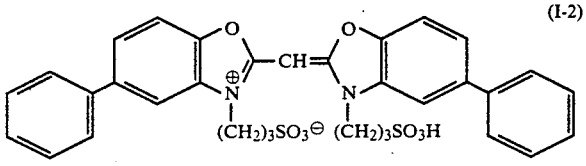
(I-3)
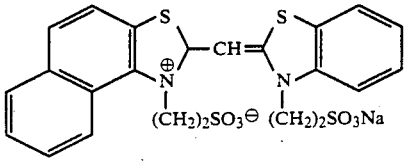
(I-4)
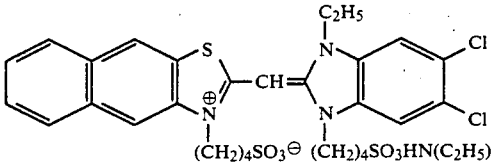
(I-5)
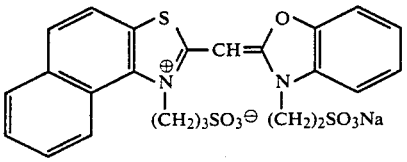
(I-6)
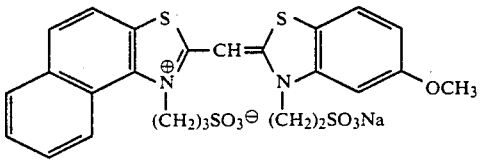
(I-7)
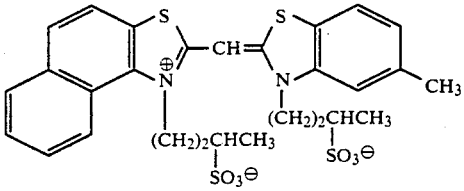
(I-8)
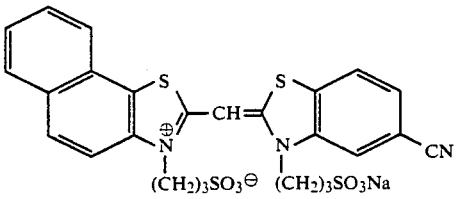
(I-9)
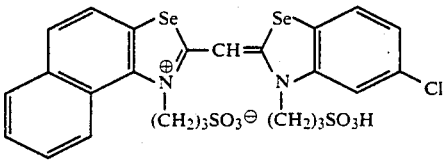
-continued
(I-10)
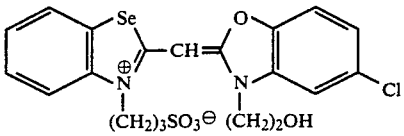
(I-11)
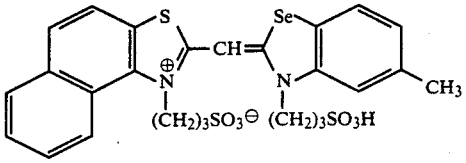
(I-12)
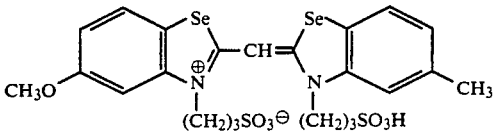
(I-13)
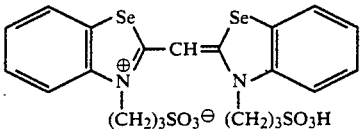
(I-14)
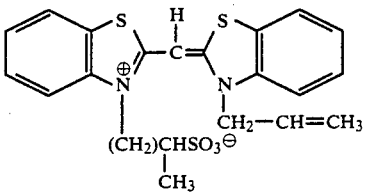
(I-15)
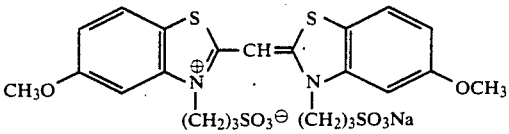
(I-16)
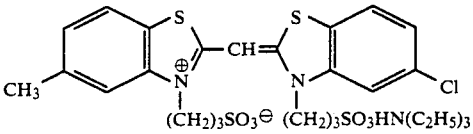
(I-17)
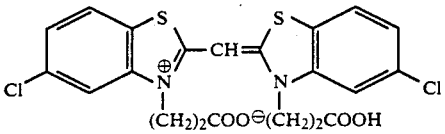
(I-18)
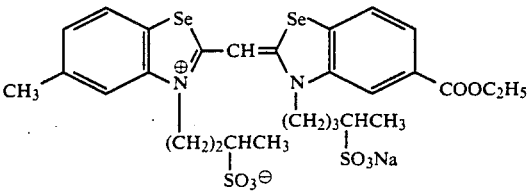
(I-19)
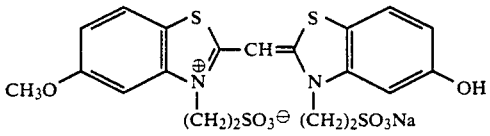

-continued
(I-20)
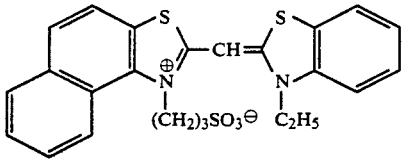
(I-21)
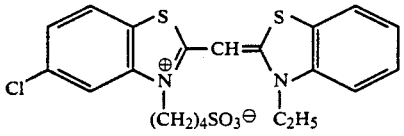
(I-22)
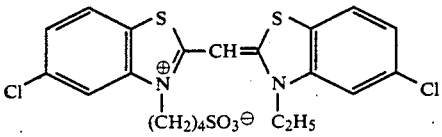
Series (II)
(II-1)
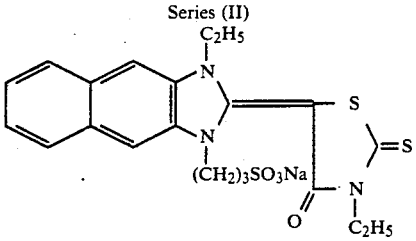
(II-2)
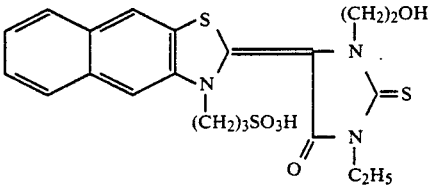
(II-3)
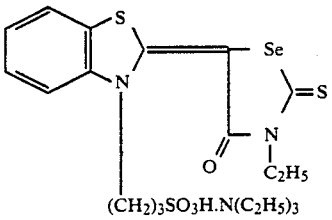
(II-4)
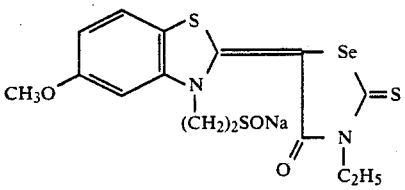
(II-5)
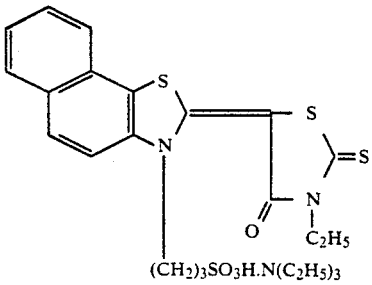
-continued
(II-6)
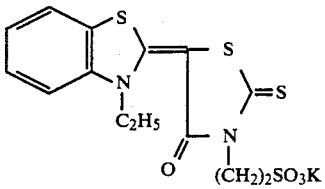
(II-7)
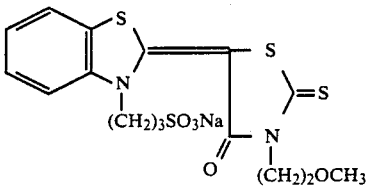
(II-8)
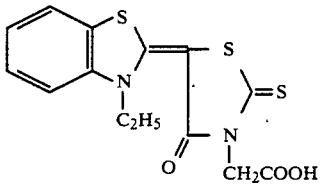
(II-9)
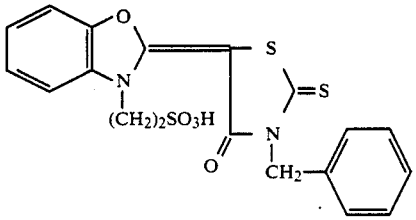
(II-10)
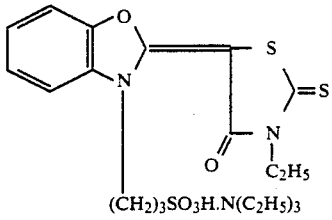
(II-11)
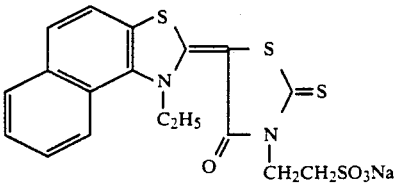
(II-12)
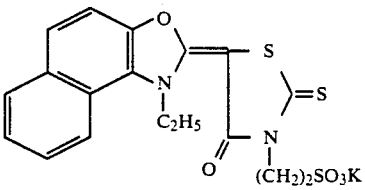
Series [III]

-continued (III-1)

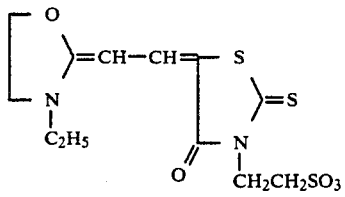

(III-2)

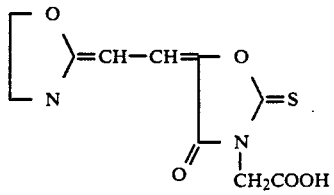

The sensitizing dyes shown by Series (I), the sensitizing dyes shown by Series (II) and the sensitizing dyes shown by Series (III) can be readily synthesized, for example, following the method described in F. A. Harmer, The Chemistry of Heterocyclic Compounds, Vol. 18, The Cyanine Dye and Related Compounds, Newly-issued Weissbergered Interscience, New York, 1964.

The maximum density of the sensitizing dyes used in the present invention can be determined according to method commonly practiced by those skilled in the art. For example, available is a method in which it is determined by a method comprising dividing a same emulsion, incorporating sensitizing dyes with different densities into the divided emulsions, respectively, and measuring the respective sensitivities.

The positive color image formed in the present invention is meant to have an image color density which is low with increase in the exposure amount. For example, the colored layer becomes colorless substantially in proportion to a logarithm of the exposure from a uniformly colored layer by a magenta coloring material. The positive color image mentioned in the present invention is formed when the formation of the magenta dye is suppressed.

The silver halide emulsion used in the present invention is made usually by mixing a water soluble silver salt (as exemplified by silver nitrate) solution with a water-soluble silver halide (as exemplified by potassium bromide) solution in the presence of a solution of a water-soluble polymer such as gelatin. Usable as this silver halide are any silver halides such as silver bromide, silver iodide, silver chlorobromide, silver iodobromide and silver chloroiodobromide which are used in usual light-sensitive silver halide photographic material.

These silver halide emulsions are prepared according to commonly used methods (as exemplified by a double jet method and a controlled double jet method). There may be mixed two or more kinds of silver halide emulsions separately formed. There may be also used those comprising silver halide grains having the crystal structure uniform through its inside or the layer structure different in nature between their inside and outside, or there may be used the co-called conversion emulsions, Lippmann's emulsion, covered grain emulsions or those beforehand optically or chemically applied with fog. Also available are any of those of the type that a latent image is principally formed on the surface or those of the internal latent image type that it is formed inside the grains. These photographic emulsions can be prepared by various methods generally recognized such as an ammoniacal method, a neutral method and an acidic method. The types of silver halide, content and mixing ratio for silver halides, average grain size, grains size distribution, etc. are appropriately selected depending on the types and purposes of light-sensitive photographic materials.

These methods are described in P. Glafkides, Chimie et Physique Photographique, published by Paul Montel, 1967; G. F. Duffin, Photographic Emulsion Chemistry, published by The Focal Press, 1966; V. L. Zelikman et al, Making and Coating Photographic Emulsion, published by The Focal Press, 1964, etc.

To form a light-sensitive photographic material, silver halides are dispersed in a suitable protective colloid to constitute a light-sensitive layer, and the protective colloid used in layer constitution of light-sensitive layers and other auxiliary layers as exemplified by intermediate layers, protective layers and filter layers commonly includes alkali-treated gelatin, besides including acid-treated gelatin, derivative gelatin, colloidal albumin and cellulose derivatives, or synthetic resins such as polyvinyl alcohol and polyvinyl pyrrolidone, which may be used alone or in combination.

The above silver halide emulsions can be sensitized by using chemical sensitizers. The chemical sensitizers are roughly grouped into four types consisting of noble metal sensitizers (such as potassium aurithiocyanate, ammonium chloropalladate and potassium chloroplatinate), sulfur sensitizers (such as arylthiocarbamides, thioureas and cystine), selenium sensitizers (such as active or inert selenium compounds) and reduction sensitizers (such as stannous salts and polyamines). The silver halide emulsions can be chemically sensitized by using these sensitizers alone or in appropriate combination.

Methods of these chemical sensitizations are described, for example, in U.S. Pat. Nos. 1,574,944, 1,623,499, 2,410,689, 2,448,060, 2,399,083, 2,642,361, 2,487,850, 2,518,698, 1,623,499 and 1,602,592. As other sensitizers, it is also possible to use polyalkylene oxide compounds.

To the above silver halide emulsions described above, other various additives can be further added. For example, there may be added a variety of photographic additives as exemplified by aldehydes such as formaldehyde, halogen substituted fatty acids such as mucobromic acid, hardening agents such as epoxy compounds, activated halogen compounds, activated vinyl compounds and ethyleneimine compounds, surface active agents such as saponin, nonionic surface active agents, cationic surface active agents, anionic surface active agent and amphoteric surface active agent, heterocyclic mercapto compounds such as azoles and 1-phenyl-5-mercaptotetrazole, azaindenes such as 4-hydroxy-6-methyl-1,3,3a,7-tetrazaindene, antifoggants or stabilizers such as benzenethiosulfonic acid and benzenesulfinic acid, property improvers such as glycerol polymer aqueous dispersions (latexes), couplers including dye image forming couplers and colored couplers such as 5-pyrazolone magenta couplers, acylacetoanilide yellow couplers and phenol or naphthol cyan couplers, competing couplers to improve the sharpness of image and graininess or control the gradation, dispersants used also as coupler solvents such as dibutyl phthalate, triphenyl phosphate, tricresyl phosphate, N,N-diethyllaurylamide, ethyl acetate, butyl acetate, chloroform and methanol, ultraviolet absorbents such as benzotriazoles, triazines and benzophenone compounds, anti-stain agents and anti-color-fading agents such as nucleus substituted hydroquinones, p-alkoxy phenols, 6-chromanols, 6,6'-dihydroxy-2,2'-spirochroman and alkoxy derivatives of these, brightening agents of stilbene types, triazine types, oxazole types or cumarine types, filter dyes and anti-irradiation dyes such as oxonol dyes, hemioxonol dyes, styryl dyes, merocyanine dyes, cyanine dyes and azo dyes.

The light-sensitive silver halide photographic material of the present invention may preferably be prepared by carrying out coating on a support having good flatness, and having good dimentional stability and less dimensional changes in the course of the preparation or in the course of the processing. Usable supports for that occasion include, for example, cellulose films, cellulose ester films, polyvinyl acetal films polystyrene films, polyethylene terephthalate films, polycarbonate films, glass, paper, metals, and paper covered with polyolefines as exemplified by polyethylene and polypropylene.

These supports can be applied with surface treatment such as various hydrophillic treatments for the purpose of improving the adhesion to photographic emulsion layers. For example, carried out are treatments such as silicating treatment, corona-discharge treatment, subbing treatment and setting treatment.

The light-sensitive silver halide photographic material of the present invention is basically constituted of a support and light-sensitive emulsion layers, but may be laminated with auxiliary layers such as subbing layers, intermediate layers, filter layers, anti-halation layers, anti-curling layer, backing layers and protective layers in appropriate combination, depending on the types of light-sensitive silver halide photographic materials.

The present invention can also be applied in multi-layer light-sensitive color photographic materials having at least two spectrally different sensitivity layers on a support.

The above multi-layer light-sensitive color photographic materials usually have on a support at least one each of a red-sensitive emulsion layer, a green-sensitive emulsion layer and a blue-sensitive emulsion layer in succession from the support side, and moreover have at least one silver halide emulsion layer having a reverse light-response to said respective emulsion layers, capable of forming an image having substantially the same hue with a formed image in said green-sensitive silver halide emulsion layer, and having a maximum sensitivity wavelength ($\lambda_{-G}$) of spectral sensitivity distribution in the range of 400 nm$\leqq\lambda_{-G}\leqq$500 nm. However, the order of these layers may be arbitrarily selected as required. It is also generally practiced to respectively incorporate cyan couplers in the red-sensitive emulsion layer, magenta couplers in the green-sensitive emulsion layer, and yellow couplers in the blue-sensitive emulsion layer.

The DIR compound capable of releasing a development restrainer or a compound capable of releasing a developing restrainer, through coupling with an oxidized product of a developing agent may be contained in a silver halide emulsion layer having the light-response reverse to the red-sensitive, green-sensitive and blue-sensitive emulsion layers, or may be contained in a layer adjacent to the above silver halide emulsion layer having the reverse light-response, and this adjacent layer may further be adjacent through an intermediate layer.

In the multi-layer light-sensitive color photographic material as described above, cyan couplers applied in the red-sensitive emulsion layer are described, for example, in U.S. Pat. Nos. 2,474,293, 2,895,826 and 3,476,563, Japanese Unexamined Patent Publication Nos. 18315/1977, 109630/1978, 32071/1980, 163537/1980 and 65134/1981, etc.

Usable magenta couplers applied in the green-sensitive emulsion layer include pyrazolone compounds, indazolone compounds and cyanoacetyl compounds, and particularly advantageous are pyrazolone compounds. Examples of usable magenta color-forming couplers are those described in U.S. Pat. Nos. 2,600,788, 2,983,608, 3,062,653, 3,127,269, 3,311,476, 3,419,391, 3,519,429, 3,558,319, 3,582,322, 3,615,506, 3,834,908 and 3,891,445, West German Patent No. 18 10 464, West German Patent Application (OLS) Nos. 24 08 665, 24 17 945, 24 18 959 and 24 24 657, Japanese Patent Publication No. 6031/1965, Japanese Unexamined Patent Publication Nos. 20826/1976, 58922/1977, 129638/1974, 74027/1974, 159336/1975, 42121/1977, 74028/1974, 60233/1975, 26541/1976 and 55122/1978, etc.

As yellow couplers applied in the blue-sensitive emulsion layer, various open-chain ketomethylene couplers can be used. Of these, advantageous are benzoyl acetanilide compounds and pivaloyl acetanilide compounds. Examples of usable yellow color-forming couplers are those described in U.S. Pat. Nos. 2,875,057, 3,265,506, 3,408,194, 3,551,155, 3,582,322, 3,725,072 and 3,891,445, West German Patent No. 15 47 868, West German Application Publication Nos. 22 19 917, 22 61 361 and 24 14 006, British Patent No. 1,425,020, Japanese Patent Publication No. 10783/1976, Japanese Unexamined Patent Publication Nos. 26133/1972, 73147/1973, 102036/1976, 6341/1975, 123342/1975, 130442/1975, 21827/1976, 87650/1975, 82424/1977 and 115219/1977.

EXAMPLES

Specific Examples of the present invention will be set out below, but the embodiments of working the present invention are by no means limited to these.

In all Examples shown below, the amount for addition in the light-sensitive silver halide photographic materials indicates the amount per 1 $m^2$ unless particularly described. Also, silver halide and colloid silver are expressed in terms of silver.

EXAMPLE 1

On a triacetyl cellulose film support, the layers each having the composition as shown below were formed in succession from the support side to prepare a multi-layer color photographic element sample 1.

Sample 1 (Comparative):

First layer; an ant-halation layer (HC-1):
A gelatin layer containing black colloid silver.

Second layer; an intermediate layer (I.L.):
A gelatin layer containing an emulsified dispersion of 2,5-di-t-octylhydroquinone.

Third layer; a low-speed red-sensitive silver halide emulsion layer (RL-1):
A polydispersed emulsion (Emulsion I) comprising AgBrI having an average grain size ($\bar{r}$) of 0.38 $\mu$m and containing 6 mol % of AgI . . . silver coating amount: 1.8 g/$m^2$.
Sensitizing dye I . . . $6\times10^{-5}$ mol per mol of silver
Sensitizing dye II . . . $1.0\times10^{-5}$ mol per mol of silver Cyan coupler (C-1) . . . 0.06 mol per mol of silver
Colored cyan coupler (CC-1) . . . 0.003 mol per mol of silver
DIR compound (D-1) . . . 0.003 mol per mol of silver Fourth layer; a high-speed red-sensitive silver halide emulsion layer (RH-1):
A polydispersed emulsion (Emulsion II) comprising AgBrI having an average grain size ($\bar{r}$) of 0.65 μm and containing 7.0 mol % of AgI . . . silver coating amount: 1.3 g/m$^2$.
Sensitizing dye I . . . $3\times10^{-5}$ mol per mol of silver
Sensitizing dye II . . . $1.0\times10^{-5}$ mol per mol of silver
Cyan coupler (C-1) . . . 0.02 mol per mol of silver
Colored cyan coupler (CC-1) . . . 0.0015 mol per mol of silver
DIR compound (D-1) . . . 0.001 mol per mol of silver Fifth layer; an intermediate layer (I.L.):
A gelatin layer like the second layer.

Sixth layer; a low-speed green-sensitive silver halide emulsion layer (GL-1):
Emulsion I . . . silver coating amount: 1.5 g/m$^2$.
Sensitizing dye III . . . $2.5\times10^{-5}$ mol per mol of silver
Sensitizing dye IV . . . $1.2\times10^{-5}$ mol per mol of silver
Magenta coupler (M-1) . . . 0.050 mol per mol of silver
Colored magenta coupler (CM-1) . . . 0.009 mol per mol of silver
DIR compound (D-1) . . . 0.0040 mol per mol of silver Seventh layer; a high-speed green-sensitive silver halide emulsion layer (GH-1):
Emulsion II . . . silver coating amount: 1.4 g/m$^2$.
Sensitizing dye III . . . $1.5\times10^{-5}$ mol per mol of silver
Sensitizing dye IV . . . $1.0\times10^{-5}$ mol per mol of silver
Magenta coupler (M-1) . . . 0.020 mol per mol of silver
Colored magenta coupler (CM-1) . . . 0.002 mol per mol of silver
DIR compound (D-1) . . . 0.0010 mol per mol of silver Eighth layer; a yellow filter layer (YC-1):
A gelatin layer an emulsified dispersion containing yellow colloid silver and 2,5-di-t-octylhydroquinone.

Ninth layer; a low-speed blue-sensitive silver halide emulsion layer (BL-1):
A polydispersed emulsion (Emulsion III) comprising AgBrI having an average grain size of 0.48 μm and containing 6 mol % of AgI . . . silver coating amount: 0.9 g/m$^2$.
Sensitizing dye V . . . $1.3\times10^{-5}$ mol per mol of silver
Yellow coupler (EY-1) . . . 0.29 mol per mol of silver Tenth layer; a high-speed blue-sensitive silver halide emulsion layer (BH-1):
A polydispersed emulsion (Emulsion IV) comprising AgBrI having an average grain size of 0.8 μm and containing 15 mol % of AgI . . . silver coating amount: 0.5 g/m$^2$.
Sensitizing dye V . . . $1.0\times10^{-5}$ mol per mol of silver
Yellow coupler (EY-1) . . . 0.08 mol per mol of silver
DIR compound (D-1) . . . 0.0015 mol per mol of silver Eleventh layer; a first protective layer (Pro-1):
A gelatin layer containing silver iodobromide (AgI: 1 mol %; average grain size: 0.07 μm) . . . silver coating amount: 0.5 g/m$^2$; and
Ultraviolet absorbents UV-1 and UV-2.

Twelfth layer; a second protective layer (Pro-2):
A gelatin layer containing polymethyl methacrylate particles (diameter: 1.5 μm) and formalin scavenger (HS-1). In each layer, a gelatin hardening agent (H-1) and a surface active agent were added in addition to the above composition.

The compounds contained in each layer of Sample 1 are as follows:

Sensitizer I: Anhydro-5,5'-dichloro-9-ethyl-3,3'-di-(3-sulfopropyl)thiacarbocyanine hydroxide
Sensitizer II: Anhydro-9-ethyl-3,3'-di-(3-sulfopropyl)-4,5,4',5'-dibenzothiacarbocyanine hydroxide
Sensitizer III: Anhydro-5,5'-diphenyl-9-ethyl-3,3'-di-(3-sulfopropyl)oxacarbocyanine hydroxide
Sensitizer IV: Anhydro-9-ethyl-3,3'-di-(3-sulfopropyl)-5,6,5',6'-dibenzoxacarbocyanine hydroxide
Sensitizer V: Anhydro-3,3'-di-(3-sulfopropyl)-4,5-benzo-5'-methoxythiacyanine

C-1

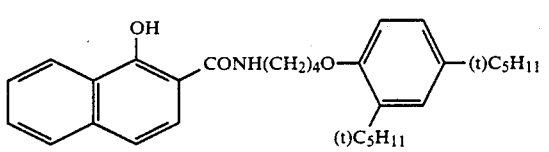

CC-1

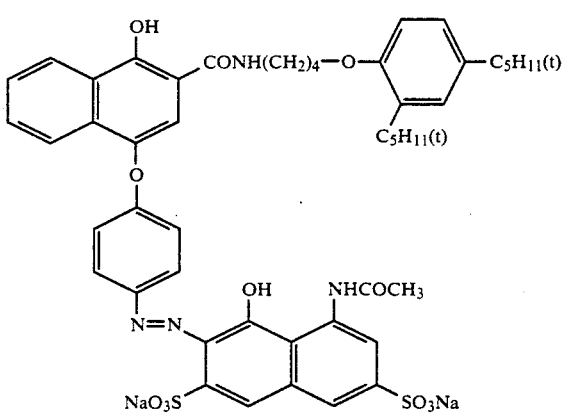

-continued
D-1
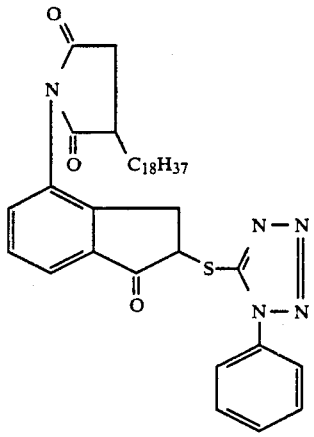
M-1
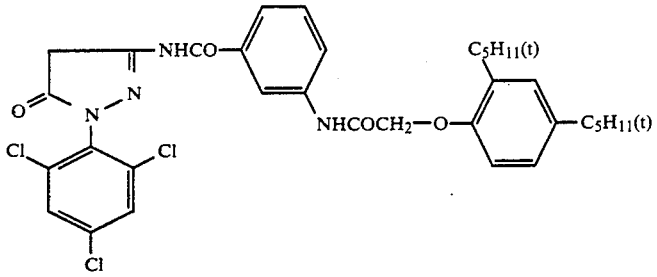
CM-1
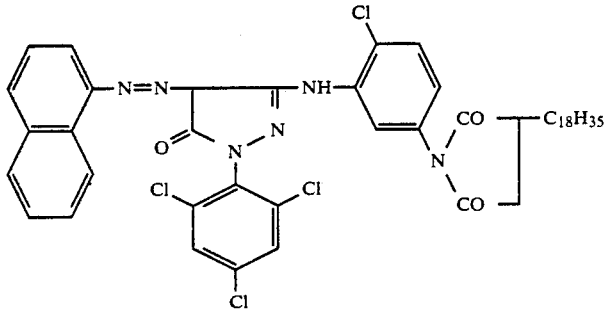
EY-1
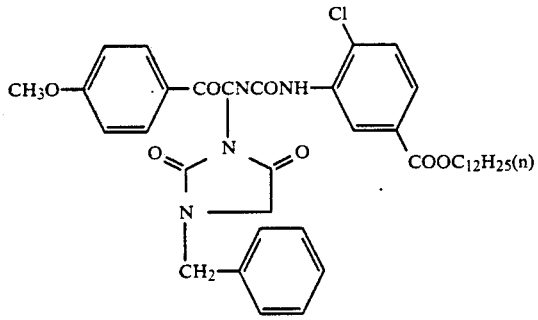
UV-1
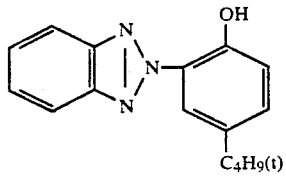
UV-2
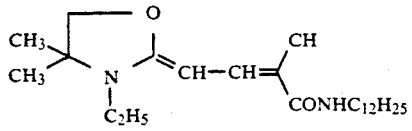

-continued

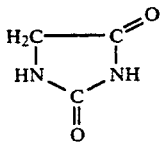

HS-1

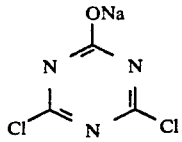

H-1

Next, the following modifications were made on Sample 1 to prepare Sample 2 and Sample 3.

Sample 2 (present invention):

A fogging emulsion layer and a DIR-compound-containing light-sensitive layer each having the following composition were provided between the eighth layer and the ninth layer.

<Fogging emulsion layer>

A polydispersed emulsion comprising AgBrI having an average grain size ($\bar{r}$) of 0.38 μm and containing 6 mol % of AgI, having been fogged by dissolving and stirring at 40° C. under a white lamp before coating (Emulsion V) . . . silver coating amount: 0.5 g/m$^2$ Magenta coupler (M-1) . . . 0.014 mol per mol of silver Colored magenta coupler (CM-1) . . . 0.003 mol per mol of silver <DIR-compound-containing light-sensitive layer>

A polydispersed emulsion comprising AgBrI having an average grain size ($\bar{r}$) of 1.0 μm and containing 15 mol % of AgI (Emulsion VI) . . . silver coating amount: 0.47 g/m$^2$ Sensitizing dye (I-2) . . . $0.8\times10^{-5}$ mol per mol of silver Coupler (D-58) . . . 0.1 mol per mol of silver Next, the following modifications were made on Sample 1 to prepare Sample 3.

Sample 3 (present invention):

Emulsion layer A having the following composition was provided between the eighth layer and the ninth layer.

<Emulsion layer A>

Emulsion (Emulsion I) . . . silver coating amount: 0.5 g/m$^2$

DDR coupler (A-1) . . . 0.005 mol per mol of silver

On Samples No. 1 to No. 3 thus prepared, color charts (Color Checker manufactured by Macbeth Company) were photographed under a day-light light source with use of a camera (Konica FT-1 MOTOR, manufactured by Konica Corporation). Subsequently, color negative development processing (CNK-4, manufactured by Konica Corporation) was carried out, and the resulting negative images were printed on color photographic papers (Sakura Color PC Paper Type SR, manufactured by Konica Corporation) with use of Sakura Color Printer CL-P2000 (manufactured Konica Corporation), followed by color paper development processing (CPK18, manufactured by Konica Corporation) to obtain prints No. 1 to No. 3 corresponding to negative Samples No. 1 to No. 3.

Printer conditions in printing were set for each sample so that the gray areas [Neutral 5] having a reflection density of 0.7 on the above color charts may be reproduced on the prints. Next, the yellow, yellowish green, green and magenta areas on the above color charts and prints No. 1 to No. 3 were measured by a reflection spectrometer (a high speed spectrophotometric chromometer CMS-1200, manufactured by Murakami Shikisai Gijutsu Kenkyusho K. K.) to obtain each spectral reflectance, and chromaticity points according to C.I.E. 1931 Standard Colorimetric System, with 2 degree field of view under a C light source according to an (L*, a*, b*) color specification system to make indication of chromaticity diagram (a*, b*).

Figure 2:
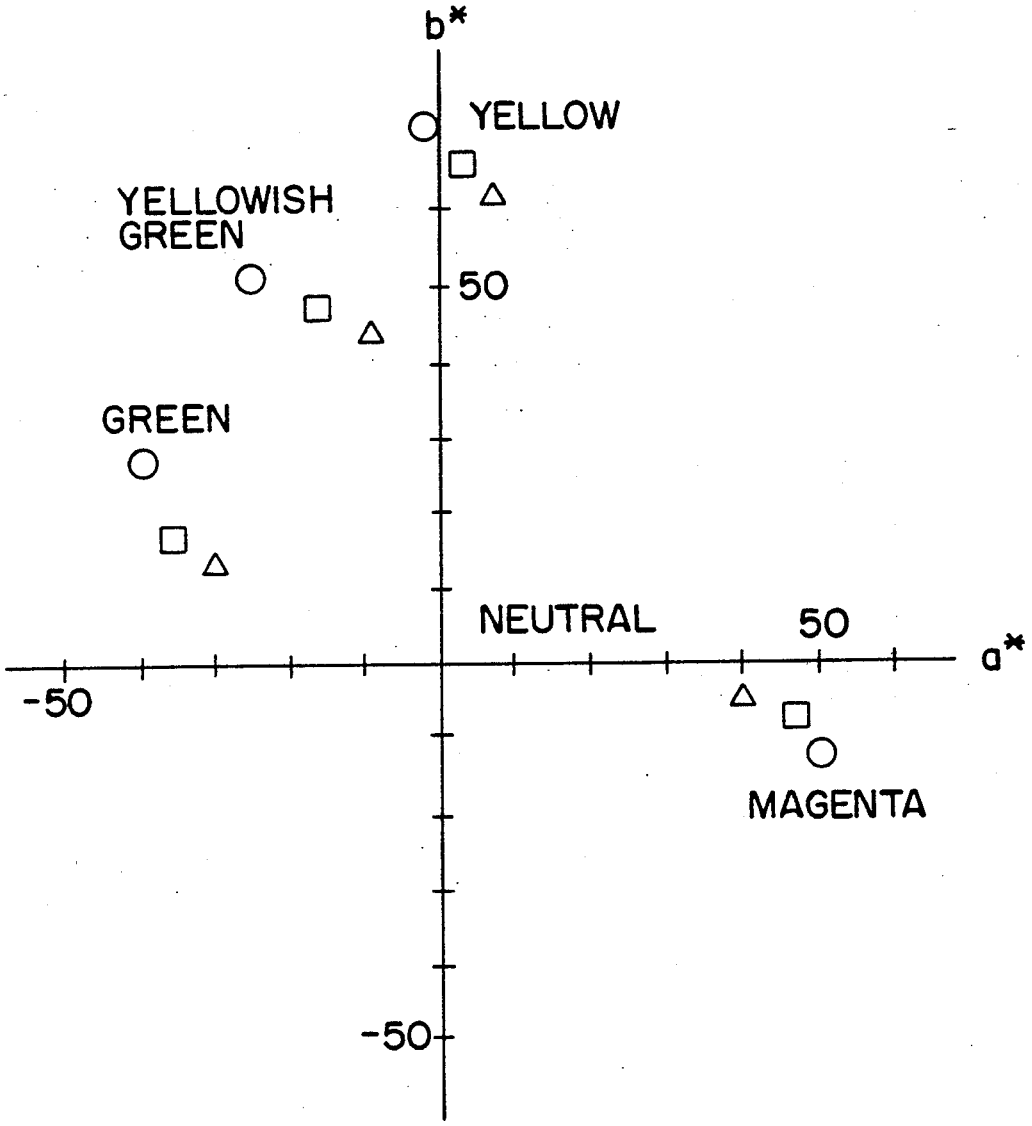

Results of measurement are shown in FIG. 1 and FIG. 2. Lightness value (L*) of each is shown in Table 1 and Table 2.

FIG. 1 is a view in which yellow, yellowish green, green and magenta are each indicated on an (a*, b*) plane of an (L*, a*, b*) color specification system, and FIG. 2 is a view in which yellow, yellowish green, green and magenta are each indicated on an (a*, b*) plane of an (L*, a*, b*) color specification system like FIG. 1 except that the square marks each color of print No. 3 using Sample No. 3.

TABLE 1

(L* in FIG. 1)

| Sample | Color | | |
|---|---|---|---|
| | Yellow | Yellowish green | Green |
| Color Chart | 77.7 | 69.1 | 54.3 |
| Print No. 1 | 73.8 | 65.3 | 42.2 |
| Print No. 3 | 75.1 | 67.8 | 48.5 |

TABLE 2

(L* in FIG. 2)

| Sample | Color | | |
|---|---|---|---|
| | Yellow | Yellowish green | Green |
| Color Chart | 77.7 | 69.1 | 54.3 |
| Print No. 1 | 73.8 | 65.3 | 42.2 |
| Pring No. 2 | 75.3 | 67.8 | 48.7 |

As will be clear from FIG. 1, print No. 2 employing the negative sample 2 of the present invention approaches the colors of objects in respect of the hues of yellow, yellowish green and magenta. Chroma also increases in regard to yellow, yellowish green, green and magenta, also approaching that of objects. As will be also clear from Table 1, the lightness values of yellow, yellowish green and green increase, approaching those of objects.

As further will be clear from FIG. 2, print No. 3 employing the negative sample No. 3 of the present invention approaches the colors of objects in respect of the hues of yellow, yellowish green and magenta. Chroma also increases in regard to yellow, yellowish green, green and magenta, also approaching that of objects. As will be also clear from Table 2, the lightness values of yellow, yellowish green and green increase, approaching those of objects.

In visual observation on actual prints, Nos. 2 and 3 were found to show color reproducibility with fidelity as being clearly closer to the objects as compared with print No. 1.

As described above, the present invention makes it possible to obtain an admirable color photographic material having superior color reproducibility with fidelity to yellow, yellowish green, green and magenta when printed.

What is claimed is:

1. The light-sensitive color photographic material comprising a support having provided thereon a plurality of light-sensitive silver halide emulsion layers including a red-sensitive silver halide emulsion layer containing a cyan coupler, a green-sensitive silver halide layer containing a magenta coupler, a blue-sensitive silver halide emulsion layer containing a yellow coupler and at least one additional silver halide emulsion layer having a reverse photo-response to that of said red, green and blue-sensitive silver halide emulsion layers, being capable of forming a reverse dye image having substantially the same hue as formed in the green-sensitive silver halide emulsion layer, and having a maximum sensitivity labeling ($\lambda_{-G}$) of the spectral sensitivity distribution in the region of from 400 nm to 500 nm, wherein said additional silver halide emulsion layer contains a negative-type silver halide emulsion which has been spectrally sensitized in the region of from 400 to 500 nm, and a DDR compound or a DRR coupler which is capable of forming a dye image having substantially the same hue as is formed in the green-sensitive silver halide emulsion layer.

* * * * *